US006575143B2

(12) United States Patent
Uemura et al.

(10) Patent No.: US 6,575,143 B2
(45) Date of Patent: Jun. 10, 2003

(54) BATTERYLESS FUEL INJECTION APPARATUS FOR MULTI-CYLINDER INTERNAL COMBUSTION ENGINE

(75) Inventors: Kiyoshi Uemura, Numazu (JP); Yoshinobu Arakawa, Numazu (JP); Kouji Sasaki, Numazu (JP); Yoshikazu Tsukada, Numazu (JP)

(73) Assignee: Kokusan Denki Co., Ltd., Numazu (JP)

( * ) Notice: Subject to any disclaimer, the term of this patent is extended or adjusted under 35 U.S.C. 154(b) by 86 days.

(21) Appl. No.: 09/962,829

(22) Filed: Sep. 25, 2001

(65) Prior Publication Data

US 2002/0038652 A1 Apr. 4, 2002

(30) Foreign Application Priority Data

Sep. 29, 2000 (JP) ..... 2000-299561

(51) Int. Cl.[7] ..... F02M 51/00
(52) U.S. Cl. ..... 123/490; 123/491; 123/479
(58) Field of Search ..... 123/490, 491, 123/479, 480, 476

(56) References Cited

U.S. PATENT DOCUMENTS

| | | | | | |
|---|---|---|---|---|---|
| 4,100,892 | A | * | 7/1978 | Asano | 123/696 |
| 4,284,053 | A | * | 8/1981 | Merrick | 123/497 |
| 4,495,927 | A | | 1/1985 | Yamato | |
| 4,656,989 | A | * | 4/1987 | Yakuwa | 123/490 |
| 4,821,194 | A | * | 4/1989 | Kawamura | 701/111 |
| 4,886,029 | A | * | 12/1989 | Lill et al. | 123/479 |
| 5,482,022 | A | * | 1/1996 | Aoki et al. | 123/479 |
| 6,123,058 | A | * | 9/2000 | Endou | 123/490 |
| 6,170,468 | B1 | | 1/2001 | Wada | |
| 6,379,284 | B1 | * | 4/2002 | Hanai et al. | 477/200 |

* cited by examiner

*Primary Examiner*—John Kwon
(74) *Attorney, Agent, or Firm*—Pearne & Gordon LLP

(57) ABSTRACT

A batteryless fuel injection apparatus for a multi-cylinder internal combustion engine adapted to generate a start injection command signal for each of cylinders in predetermined order whenever a reference pulse signal is generated by a signal generation device in case that which cylinder the reference pulse signal corresponds to cannot be judged to inject a fuel from the injector for each of the cylinders and to generate the injection command signal for each of the cylinders at a regular injection start position after which cylinder the reference pulse signal corresponds to is judged.

7 Claims, 3 Drawing Sheets

Vp
Vs
Vi a',Vi a
Vi b',Vi b
Vi c',Vi c
VG
Vo

Vp1
Vp2
Vs1
Vs2
#?
#1
#2
#3
a
Vi a
Vi a'
Vi b
Vi b'
Vi c
Vi c'
θ
STARTING OPERATION BEGINS
CYLINDER JUDGMENT FINISHES

Vp
Vs
Vi a
Vi b
Vi c
VG
Vo

Vs1
Vs2
Vp1
Vp2
#?
#1
#2
#3
θ1
θ2
θ
STARTING OPERATION BEGINS
CYLINDER JUDGMENT FINISHES

BATTERYLESS FUEL INJECTION APPARATUS FOR MULTI-CYLINDER INTERNAL COMBUSTION ENGINE

TECHNICAL FIELD OF THE INVENTION

This invention pertains to a batteryless fuel injection apparatus for a multi-cylinder internal combustion engine for driving an injector injecting a fuel into an intake pipe or a cylinder of a multi-cylinder internal combustion engine by an output of a generator driven by the engine without using any battery.

BACKGROUND OF THE INVENTION

Such a fuel injection apparatus comprises an injector in the form of an electromagnetic fuel injection valve provided for each of the cylinders of the multi-cylinder internal combustion engine to inject the fuel into the intake pipe or the cylinder, a fuel pump to supply the fuel to the injector, an electric power circuit using an AC generator serving as an electric power source to generate a constant DC voltage, a signal generation device to generate pulse signals including a reference pulse signal for each of the cylinders which is generated at a reference rotational angle position set relative to each of the cylinders of the internal combustion engine and an electronic control unit (ECU) to receive an output of the signal generation device and outputs of various sensors such as a cooling water temperature sensor, an intake pipe internal pressure sensor, an air flow quantity sensor and so on serving to detect the conditions of the engine to control the injector for each of the cylinders using an output voltage of the electric power circuit as an electric power voltage.

The ECU generally comprises a microcomputer and includes cylinder judgment means to judge which cylinder each of the reference pulse signal generated by the signal generation device corresponds, injection quantity arithmetical operation means to arithmetically operate a fuel injection quantity from the injector for each of the cylinders using an rotation information of the engine obtained from the pulse signals generated by the signal generation device and various control conditions obtained from the various sensors, steady-state injection command generation means to generate an injection command signal for each of the cylinders having a signal width necessary for injecting the fuel from the injector for each of the cylinders in the injection quantity arithmetically operated by the injection quantity arithmetical operation means at the injection start position for each of the cylinders determined relative to the generation position of the reference pulse signal for each of the cylinders judged by the cylinder judgment means and an injector drive circuit to supply to the injector for each of the cylinders a drive current of valve-open level or higher using the output voltage of the electric power circuit as an electric power voltage while the injection command signal for each of the cylinders is generating.

The injector comprises a valve body having a fuel injection port at its leading end, a valve to open and close the fuel injection port of the valve body and an electromagnet for driving the valve body disposed within the valve body. The valve body is opened to inject the fuel while the drive current of valve-open level or higher is being supplied to the electromagnet.

The injector drive circuit to supply the drive current to the injector comprises a switch that gets an on-state while the injection command signal of rectangular waveform is being applied. The drive current flows from the electric power circuit through the switch to a drive coil for the injector.

Since a pressure of the fuel applied to the injector is normally kept constant by a pressure regulator, the injection quantity of the fuel from the injector is determined by the signal width of the injection command signal that corresponds to the fuel injection time.

In order to judge which cylinder each of a series of reference pulse signals generated by the signal generation device corresponds to, it is known that the signal generation device is adapted to generate a distinguishable cylinder judgment signal (a signal different from the reference pulse signals in its pulse width and its generation distance) which can be recognized by the ECU immediately before a reference rotational angle position of the specific cylinder (a rotational angle position of a crankshaft when a piston of the specific cylinder reaches the reference position for determining the ignition position and the fuel injection start position) to recognize that the reference pulse signal generated immediately after the cylinder judgment signal is detected is one corresponding to the specific cylinder or that a cylinder judgment signal generation device to generate a cylinder judgment signal (a signal generating once per one ignition cycle of the engine) is provided in addition to the signal generation device to generate the reference pulse signal to recognize that the reference pulse signal generated immediately after the cylinder judgment signal generation device generates the cylinder judgment signal corresponds to the specific cylinder.

Thus, it cannot be generally judged which the reference pulse signal corresponds to immediately after the starting operation begins when the engine should start, which will be referred to just as that the cylinder is judged later and the cylinder cannot be judged until the cylinder judgment signal is detected after the starting operation begins.

As aforementioned, the fuel injection apparatus for the multi-cylinder internal combustion engine is provided with the cylinder judgment means to judge which cylinder each of a series of the reference pulse signals generated by the signal generation device corresponds to determine the fuel injection start position of the injector for each of the cylinders based on the reference pulse signal for each of the cylinders judged by the cylinder judgment means. Thus, since the ECU cannot judge the cylinder for a while after the starting operation of the engine begins, the ECU simultaneously applies the injection command signals to all the injectors for the cylinders when each of the reference pulse signals is generated while the cylinders cannot be judged so that all the injectors for the cylinders simultaneously inject the fuel.

In case that the aforementioned fuel injection apparatus is used for a vehicle driven by the internal combustion engine and having no battery mounted thereon, the injector and the ECU are driven using a generator driven by the internal combustion engine as an electric power source.

As aforementioned, in some vehicle driven by the internal combustion engine having no battery mounted thereon, the injectors for all the cylinders are simultaneously operated when the engine starts. However, since the time for which the fuel is injected is so set longer as to improve the startability of the engine when it starts, the simultaneous operation of the injectors for all the cylinders tends to make the load of the generator excessive. In addition thereto, in the vehicle having no battery mounted thereon, since the engine is put into operation by human power using a recoil starter or a kick starter, the output voltage of the generator varies when the engine starts, which tends to cause the electric power voltage for the ECU or the injectors to be unstable.

Thus, some internal combustion engine having the batteryless fuel injection apparatus used stops the operation of the ECU or repeat the stop of the operation and the resumption thereof due to the electric power voltage for the ECU lower than the minimum operation voltage therefor so that the injection of the fuel is not positively made and the engine fails to start. Even if the ECU can continue to be operated, the engine may be hard to start because the quantity of injection of the fuel is insufficient for the engine to start as the drive voltage of the injectors is lowered.

As the stop of the operation of the ECU and the resumption thereof are repeated when the engine starts, the simultaneous injection of the fuel into all the cylinders causes the fuel to be injected in the excessive amount, the ignition coils tend to be wet with the fuel, which sometimes disables the engine to start.

Especially, with the electrically driven fuel pump used for the fuel pump for supplying the fuel to the injectors, since the fuel pump acts as the load of the generator, the aforementioned problems further tend to arise.

Since the four cycle internal combustion engine has the large starter load and therefore the sufficiently higher rotational speed of the engine when it starts cannot be obtained, the output voltage of the generator tends to be short, which causes the aforementioned problems to arise in the same manner.

In order to prevent the aforementioned problems, it will be considered that the fuel begins to be injected by confirming that the relation of the correspondence of the cylinder to the reference pulse signal can be judged after the starting operation of the engine begins. In this case, since the start of the fuel injection is delayed, the amount of the fuel injection is short, which further disables the engine to start.

SUMMARY OF THE INVENTION

Accordingly, it is a principal object of the invention to provide a batteryless fuel injection apparatus for a multi-cylinder internal combustion engine adapted to improve the startability of the engine by preventing a drive voltage for an ECU and injectors from getting less than the minimum operation voltage thereof when the engine should start.

It is another object of the invention to provide a batteryless fuel injection apparatus for a multi-cylinder internal combustion engine adapted to improve the startability of the engine by positively injecting the fuel when the engine should start even though such a starter as used for a four cycle internal combustion engine has a large load so that a rotational speed of a generator cannot sufficiently increase.

In order to accomplish the object of the invention, the present invention provides a batteryless fuel injection apparatus for a multi-cylinder internal combustion engine comprising an injector provided for each of cylinders of the multi-cylinder internal combustion engine having n (n is an integer of 2 or more) cylinders to open a valve when a drive current of valve opening level or higher is applied to the valve to inject a fuel, a generator driven by the internal combustion engine, an electric power circuit to generate a predetermined DC voltage using the generator as an electric power source, a signal generation device to generate a reference pulse signal for each of the cylinders at a reference rotational angle position set relative to each of the cylinders, cylinder judgment means to judge which cylinder each of the reference pulse signals generated by the signal generation device corresponds to, injection quantity arithmetical operation means to arithmetically operate an injection quantity of the fuel from the injector for each of the cylinders using a rotation information obtained from the pulse signals generated by the signal generation device and control conditions obtained from various sensors, steady-state injection command generation means to generate an injection command signal for each of the cylinders having a signal width necessary for injecting the fuel from the injector for each of the cylinders in the injection quantity arithmetically operated by the injection quantity arithmetical operation means at the injection start position for each of the cylinders determined relative to the generation position of the reference pulse signal for each of the cylinders judged by the cylinder judgment means and an injector drive circuit to supply a drive current to the injector for each of the cylinders using the output voltage of the electric power circuit as an electric power voltage while the injection command signal for each of the cylinders is generating, the batteryless fuel injection apparatus further comprising start injection command generation means to generate a start injection command signal for each of the injectors or a start injection command signal common to m injectors (m is an integer of more than 1, but less than n) in predetermined provisional order to apply the start injection command signal to the injector drive circuit.

In general, as a crankshaft rotates for an angle corresponding to at least one ignition cycle after the starting operation of the engine begins, the judgment of the cylinders can be made. For instance, in case that a cylinder judging pulse is detected to judge the cylinders, as the crankshaft rotates for the angle corresponding to at least one ignition cycle, the cylinder judging pulses are always detected and therefore the cylinders can be judged. After the cylinders can be judged, the injection command signal generated by the steady-state injection command generation means is applied to the injector drive circuit whereby the injector for each of the cylinders can inject the fuel at the normal injection start position of the injector for each cylinder.

As aforementioned, after the starting operation of the engine begins and until the cylinder judgment means can judge the cylinders, as the start injection command signal for each of the cylinders or the start injection command signal common to one or more cylinders among the cylinders, but not all the cylinders is generated in provisional order to apply the start injection command signal to the injector drive circuit, even though the generator cannot generate enough output, all the injectors never serve as load of the generator simultaneously. This prevents the operation of the ECU from being unstably made due to the reduction of the output of the generator or stopping. Thus, because of the insufficient operation of the ECU due to the power voltage variation, there can be prevented from producing such troubles as the engine fails to start or is hard to start due to the ignition plug wet with the fuel.

The ECU determines the position of generation of the steady-state injection command signal on the position of generation of the reference pulse signal generated by the signal generation device. Thus, the start injection command generation means is preferably so constructed that the position of generation of the start injection command signal is determined by the reference pulse signal generated by the signal generation device.

With the fuel injected in provisional order immediately after the starting operation of the engine begins as aforementioned, when the fuel is injected at the normal fuel start position in accordance with the normal injection command signal generated by the steady-state injection command signal generation means after the cylinder can be judged, there possibly occurs an excess or a deficiency of the actual fuel injection quantity relative to the required injection quantity at any specific cylinder even though provisionally. In case that the excessive or deficient fuel injection quantity adversely affects the operation of the engine so that it cannot ignore, the correction of the excess or the deficiency should be made when the fuel is injected from the injector for each of the cylinders by the normal injection command signal.

To this end, there may be provided, for instance, start injection time storage means to store as a start injection time an accumulative value of injection time for which the fuel is injected by the injector for each of the cylinders in accordance with the start injection command signal and injection quantity correction means to judge the excess or the deficiency of the quantity of fuel already injected by the injector for each of the cylinders relative to the required quantity of fuel injection of each of the cylinders from the start injection time stored in the start injection time storage means when the injection command signal for each cylinder is switched from start injection command signal to the normal injection command signal generated by the steady-state injection command generation means and correct the signal width of the injection command signal generated by the steady-state injection command generation means so as to reduce the excess or the deficiency of the fuel quantity.

As the fuel quantity correction means is provided in this manner, the specific cylinder can be prevented from having the excessive or deficient fuel injection quantity when the engine should start and therefore the startability of the engine can be improved.

The correction of the injection quantity can be accomplished not only by the correction of the signal width, but also by stopping the normal injection command signal from being first generated by the steady-state injection command generation means in case that the excessive quantity of the fuel is already injected. More particularly, the injection quantity correction means may be so constructed as to correct the fuel injection quantity from the injector for each of the cylinders by controlling the normal injection command signal in such a manner as the signal width of the normal injection command signal first generated by the steady-state injection command generation means is narrowed or the first normal injection command signal stops from being generated in case that the quantity of the fuel already injected at each of the cylinders is more than the required injection quantity before the judgment of the cylinder finishes and the signal width of the normal injection command signal first generated by the steady-state injection command generation means is widened in case that the quantity of the fuel already injected to each of the cylinders is less than the required injection quantity.

In order to correct the excess or the deficiency of the fuel injection quantity, there may be provided, for instance, start injection frequency storage means to store the number of times of the fuel injection made by the injector for each of the cylinders in accordance with the start injection command signal and injection quantity correction means to judge the excess or the deficiency of the quantity of the fuel already injected by the injector for each of the cylinders relative to the required quantity of fuel injection of each of the cylinders from the number of times of fuel injection stored in the start injection frequency storage means when the injection command signal for each of the cylinders is switched from the start injection command signal to the normal injection command signal generated by the steady-state injection command generation means and correct the signal width of the injection command signal generated by the steady-state injection command generation means so as to reduce the excess or the deficiency of the fuel quantity.

In this case, the first normal injection command signal may also stop from being generated by the steady-state injection command generation means in case that the quantity of fuel already injected at each of the cylinders before the judgment of the cylinder finishes.

In case an electric pump is used as a pump to supply the fuel to the injectors, the electric pump also serves as loaded of the generator. In this case, since the fuel pump serves as big load of the generator, the generator tends to have excessive load if the injectors for all the cylinders are simultaneously driven and the power voltage of the ECU tends to be reduced.

Accordingly, the invention may be advantageously applied to the fuel injection apparatus in which the fuel pump serves as load of the generator in addition to the injectors.

BRIEF DESCRIPTION OF THE DRAWINGS

The above and other objects and features of the invention will be apparent from the detailed description of the preferred embodiments of the invention, which are described and illustrated with reference to the accompanying drawings, in which.

DETAILED DESCRIPTION OF PREFERRED EMBODIMENTS

Figure 1:
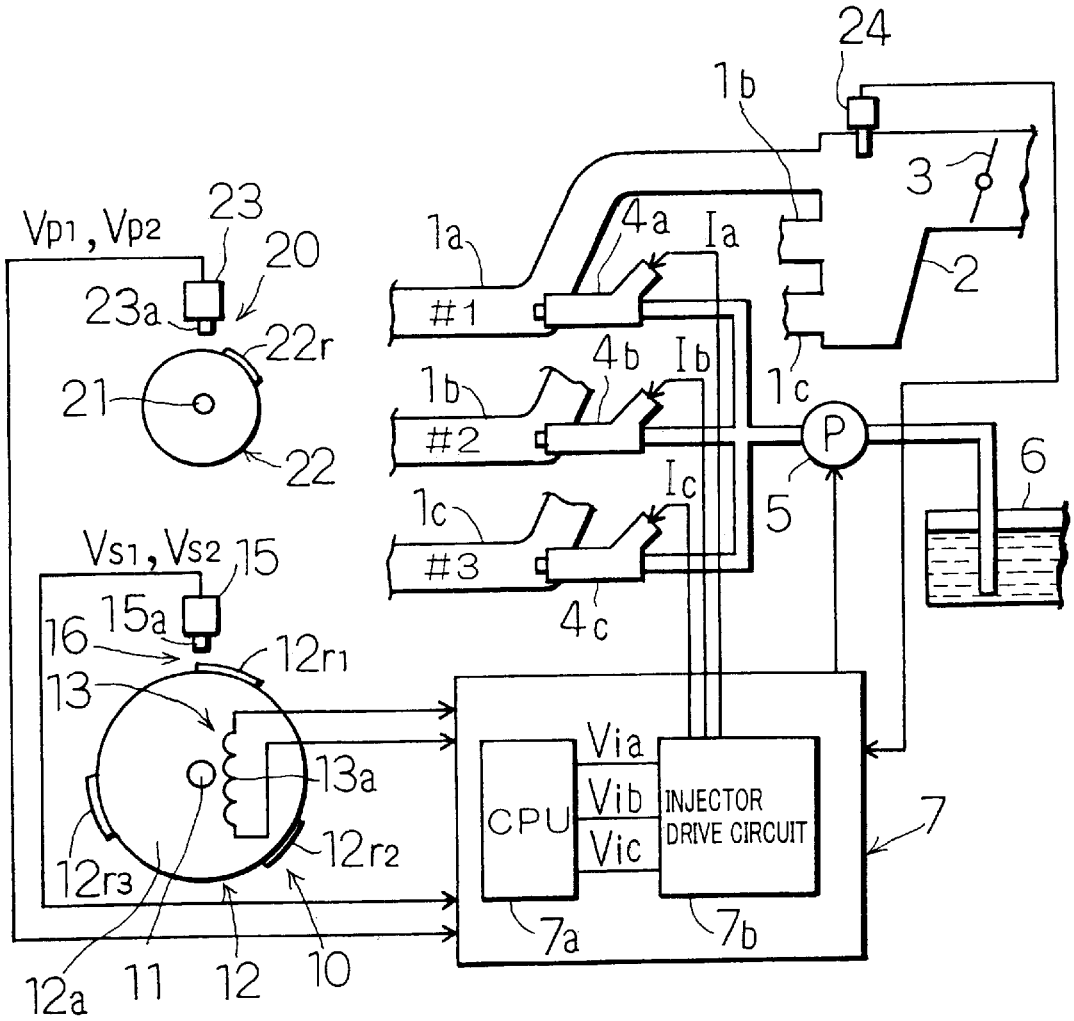
FIG. 1 is a schematic diagram of a fuel injection apparatus constructed in accordance with an embodiment of the invention.

Referring now to FIG. 1, there is briefly shown a batteryless fuel injection apparatus for a multi-cylinder internal combustion engine constructed in accordance with one embodiment of the invention. In this embodiment, the fuel injection apparatus of the invention is supposed to be applied to a four-cycle three-cylinder internal combustion engine. FIGS. 2A through 2F illustrate waveforms of voltages at various portions of the fuel injection apparatus of FIG. 1 together with a rectified output of a generator while FIG. 3A through 3F illustrate waveforms of voltages at various portions of the prior art fuel injection apparatus together with a rectified output of the generator. A reference code θ on a horizontal axis of FIGS. 2 and 3 designates a rotational agree of a crankshaft of the internal combustion engine.

Intake pipes 1*a* through 1*c* provided for first through third cylinders of the internal combustion engine at one end communicate through a throttle body 2 and a not shown air filter with an atmosphere and at another end is connected to not shown intake ports of the first through third cylinders of the internal combustion engine. Codes #1, #2 and #3 indicated in FIG. 1 are shown to be provided corresponding to the first through third cylinders, respectively. In the throttle body 2 is provided a throttle valve 3 serving to adjust a flow rate of an intake air that passes through the throttle body 2. Injectors 4*a* through 4*c* for the first through third cylinders are provided in the intake pipes 1*a* through 1*c* for the first through third cylinders, respectively.

A fuel pump 5 serves to supply a drawn up fuel from a fuel pump 6 to the injectors 4*a* through 4*c* and an electric pump is used as the fuel pump 5 in this embodiment. In practice, a pressure regulator is provided to control a fuel pressure applied to fuel supply ports of the injectors 4*a* through 4*c* so as to keep it at a constant value, but it is not shown in FIG. 1.

An electronic control unit (ECU) 7 serves to control electronic auto-parts incidentally used for the engine and comprises a microcomputer 7*a* and an injector drive circuit 7*b* and in addition thereto, an interface circuit to convert an input signal into a signal that can be recognized by the microcomputer, a fuel pump drive circuit, an ignition signal output circuit to apply an ignition signal to an ignition system for the internal combustion engine and an electric power circuit to rectify an AC power voltage by a generator described later to generate a DC voltage to be applied across electric power terminals of the microcomputer or generate a DC voltage used as an electric power voltage for the injectors 4*a* through 4*c* or a DC voltage applied to the fuel pump 5, all of which are not shown in FIG. 1.

Drive currents Ia through Ic are supplied from the injector drive circuit 7*b* to the injectors 4*a* through 4*c* and a drive current is supplied from the fuel pump drive circuit to the fuel pump 5.

A magneto generator 10 driven by a crankshaft 11 of the internal combustion engine not shown comprises a flywheel magnet rotor 12 and a stator 13. The flywheel magnet rotor 12 may be a conventional one that comprises a cup-like flywheel 12*a* of ferromagnetic material such as iron mounted on the crankshaft 11 and a permanent magnet mounted on an inner face of a peripheral wall of the flywheel. The stator 13 comprises an armature core having a magnetic pole faced to the magnet field formed by the permanent magnet of the flywheel magnet rotor 12 and a generation coil 13*a* wound on the armature core. The stator 13 is fixed to a stator mount provided on an engine case and so on. In this embodiment, the generation coil 13*a* of the generator 13 is used as an electric power supply for the ECU 7, the injectors 4*a* through 4*c* and the fuel pump 5.

Three reluctors 12*r*1 though 12*r*3 of circular arc-like protrusion are formed on an outer face of the flywheel 12*a* for an angular distance of 120° while a pulser 15 is mounted on the engine case and so on and serves to detect a front edge or a rear edge of the reluctors 12*r*1 through 12*r*3 as viewed in the rotational direction of the rotor 12 to generate pulse signals of different polarities. The pulser 15 comprises a core having a magnetic pole 15*a* provided faced to the reluctors 12*r*1 through 12*r*3, a pulser coil wound on the core and a permanent magnet magnetically bonded to the core. The pulser serves to generate the pulse signals of different polarities when the reluctors 12*r*1 through 12*r*3 begin to be faced to the magnetic pole 15*a* or the pulser 15 detects the front edge of the reluctors 12*r*1 through 12*r*3 as viewed in the rotational direction and when the reluctors 12*r*1 through 12*r*3 finish to be faced to the magnetic pole 15*a* or the pulser 15 detects the rear edge of the reluctors 12*r*1 through 12*r*3 as viewed in the rotational direction. A signal generating rotor is formed by the flywheel 12*a* and the reluctors 12*r*1 through 12*r*3 and a signal generation device 16 is formed by the rotor and the pulser 15.

Figures 2A, 2B, 2C, 2D, 2E, 2F:
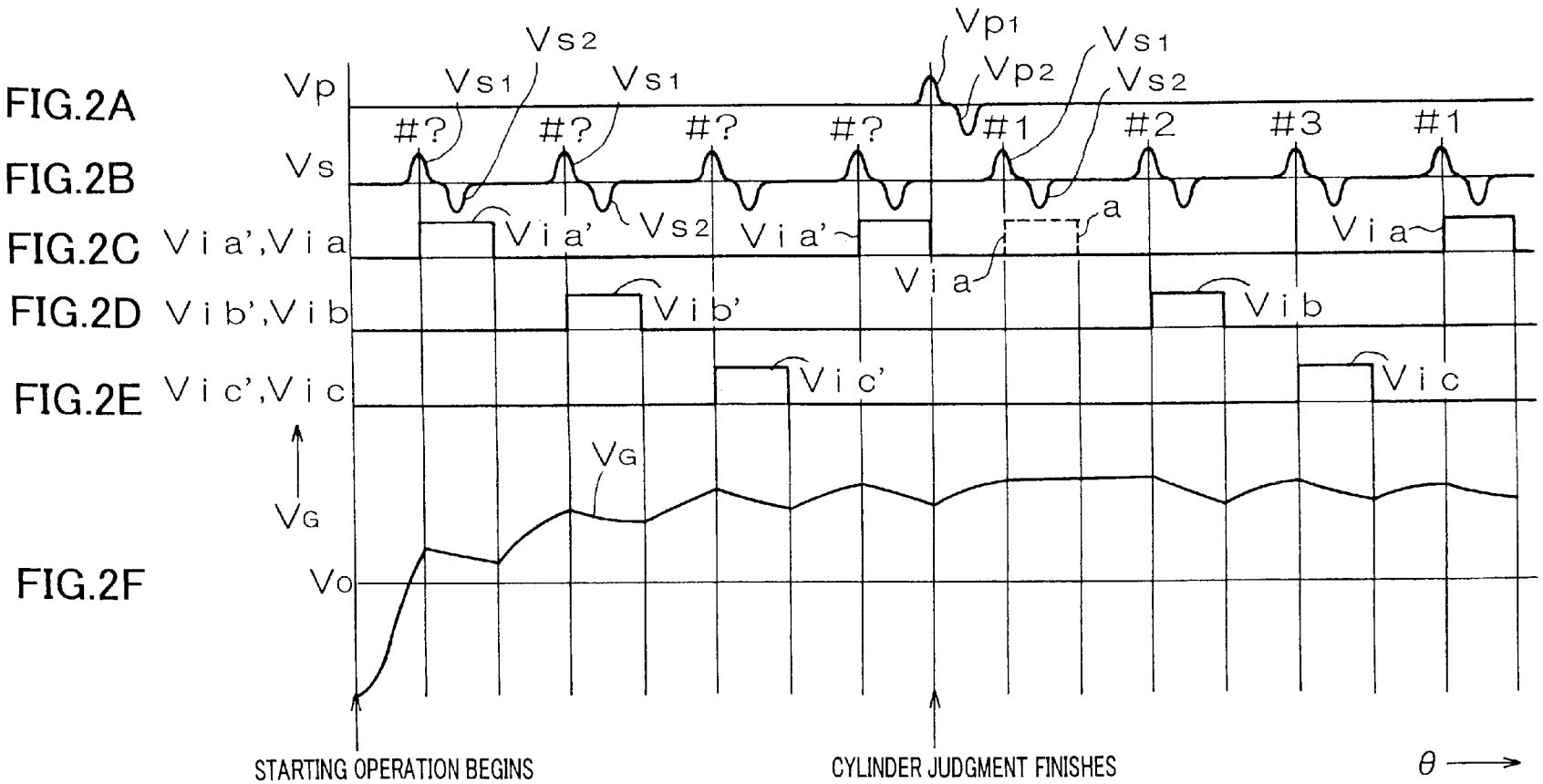
FIGS. 2A through 2F illustrate waveforms of voltages at various portions of the fuel injection apparatus of FIG. 1 together with a rectified output of the generator.

In the illustrated embodiment, as shown in FIG. 2B, when the pulser 15 detects the respective front edges of the reluctors 12*r*1 through 12*r*3, the pulse signals Vs1 of positive polarity are induced across the pulser coil and when the pulser 15 detects the respective rear edges of the reluctors 12*r*1 through 12*r*3, the pulse signals Vs2 of negative polarity are induced across the pulser coil. The pulse signals Vs1 of positive polarity generated when the pulser 15 detect the respective front edges of the reluctors 12*r*1 through 12*r*3 are used as reference pulse signals for the first through third cylinders, respectively. In FIGS. 2A through 2F, the signals having codes of #1 through #3 designated, respectively are ones for the first through third cylinders of the engine, respectively.

Referring again to FIG. 1, there is shown a cylinder judgment signal generator 20, which comprises a rotor 22 mounted on a cam shaft 21 rotating at a rotational speed as half as that of the crankshaft of the engine and a pulser 23 fixed to the engine case and so on. The rotor 22 may comprise a rotating body having a reluctor 22*r* provided on a cylindrical outer face thereof while the pulser 23 may comprise a core having a magnetic pole 23*a* faced to the reluctor 22*r*, a pulser coil wound on the core and a magnet magnetically bonded to the core. The pulser 23 generates pulse signals of different polarities when it detects the front and rear edges of the reluctor 22*r* as viewed in the rotational direction, respectively. In this embodiment, as shown in FIG. 2A, when the pulser 23 detects the front and rear edges of the reluctor 22*r* as viewed in the rotational direction, respectively, the pulse signals Vp1 and Vp2 of positive and negative polarities are generated, respectively. Since the cam shaft 21 rotates one revolution while the crankshaft rotates two revolutions, the pulse signals Vp1 and Vp2 are generated every once while the crankshaft rotates two revolutions. In the embodiment, the first generated pulse signal Vp1 of positive polarity among the pulse signals generated by the cylinder judgment signal generator 20 is used as a cylinder judgment signal.

The reference pulse signal for each cylinder generated by the pulser 15 of the signal generation device 10 is input to the ECU 7 together with the cylinder judgment signal generated by the pulser 23 of the cylinder judgment signal generator 20. To the ECU 7 are also supplied outputs of a pressure sensor 24 to measure the pressure in the throttle body 2, a not shown temperature sensor to detect a temperature of cooling water of the engine and so on.

By the microcomputer 7*a* in the ECU 7 is accomplished means to judge a relation of phase between the cylinder judgment signal Vp1 generated by the cylinder judgment signal generator 20 and the reference pulse signal Vs1 generated by the signal generation device 16 (to judge in what position the reference pulse signals Vs1 sequentially generated by the signal generation device is generated after a cylinder judgment signal is generated) and it is judged that the reference pulse signal first generated after the cylinder judgment signal Vp1 is generated is for the first cylinder and that the reference pulse signals generated in the second and third after the cylinder judgment signal is generated are for the second and third cylinders, respectively. In this embodiment, cylinder judgment means is formed by the cylinder judgment signal generator 20 and means to judge the relation of phase between the cylinder judgment signal and the reference pulse signal.

In case that the cylinder corresponding to each of the reference pulse signals is judged by this cylinder judgment means, the judgment of the cylinder cannot be made until the cylinder judgment signal is input.

In FIG. 2A, the codes #1, #2 and #3 designate the reference pulse signals corresponding to the first through third cylinders of the engine, the codes of #? designate the pulse signal which are never judged to correspond to any cylinder.

The reference pulse signals generated by the signal generation device 16 are used as the signals providing the reference position where the ignition time of each of the cylinders arithmetically operated by the ECU 7 is measured or the reference position where the fuel injection start time of each of the cylinders is measured.

The ECU 7 arithmetically operates the rotational speed of the engine from the intervals of generation of the pulse signals Vs1 and Vs2 generated by the pulser 15 of the signal generation device and then arithmetically operates the ignition time, the fuel injection start time and the injection time for each of the cylinders in accordance with the thus obtained rotational speed and the control conditions detected by various sensors.

The microcomputer 7*a* of the ECU 7 arithmetically operates the ignition time for each of the cylinders in the form of the time (the number of clock pulses to be counted) taken for the crankshaft to rotate from the reference position for each of the cylinders (the position of generation of the reference pulse signal) to the rotation angle position corresponding to the ignition time for each of the cylinders. When the reference pulse signal for each of the cylinders is generated, the arithmetically operated ignition time begins to be measured and when the measurement of the ignition time finishes, the ignition signal is applied to the not shown ignition system to make the ignition operation.

Also, the microcomputer 7*a* of the ECU 7 determines the fuel injection start time for each of the cylinders relative to the time of generation of the reference pulse signal for each of the cylinders and generates injection command signals Via, Vib and Vic of rectangular waveform at the fuel injection start times for the first through third cylinders. In some case, the fuel injection start time is kept constant and in another case, it varies in accordance with various control conditions, but in this embodiment, the fuel injection start time is kept constant and the injection command signals Via through Vic which command the injectors to inject the fuel at the timing itself when the reference pulse signal for each of the cylinders is generated as the fuel injection start time of each of the cylinders.

The injector drive circuit 7*b* passes drive currents Ia through Ic through drive coils of the injectors 4*a* through 4*c* while the injection command signals Via through Vic are given. The injectors 4*a* through 4*c* inject the fuel into the intake pipes 1*a* through 1*c*, respectively by opening the respective valves thereof while the given drive current are at valve-opening level or higher. Since the fuel pressure applied to from the fuel pump 5 to the respective injectors is kept constant, the injection quantity of the fuel of each of the cylinders is determined on the signal width of the injection command signal.

Figures 3A, 3B, 3C, 3D, 3E, 3F:
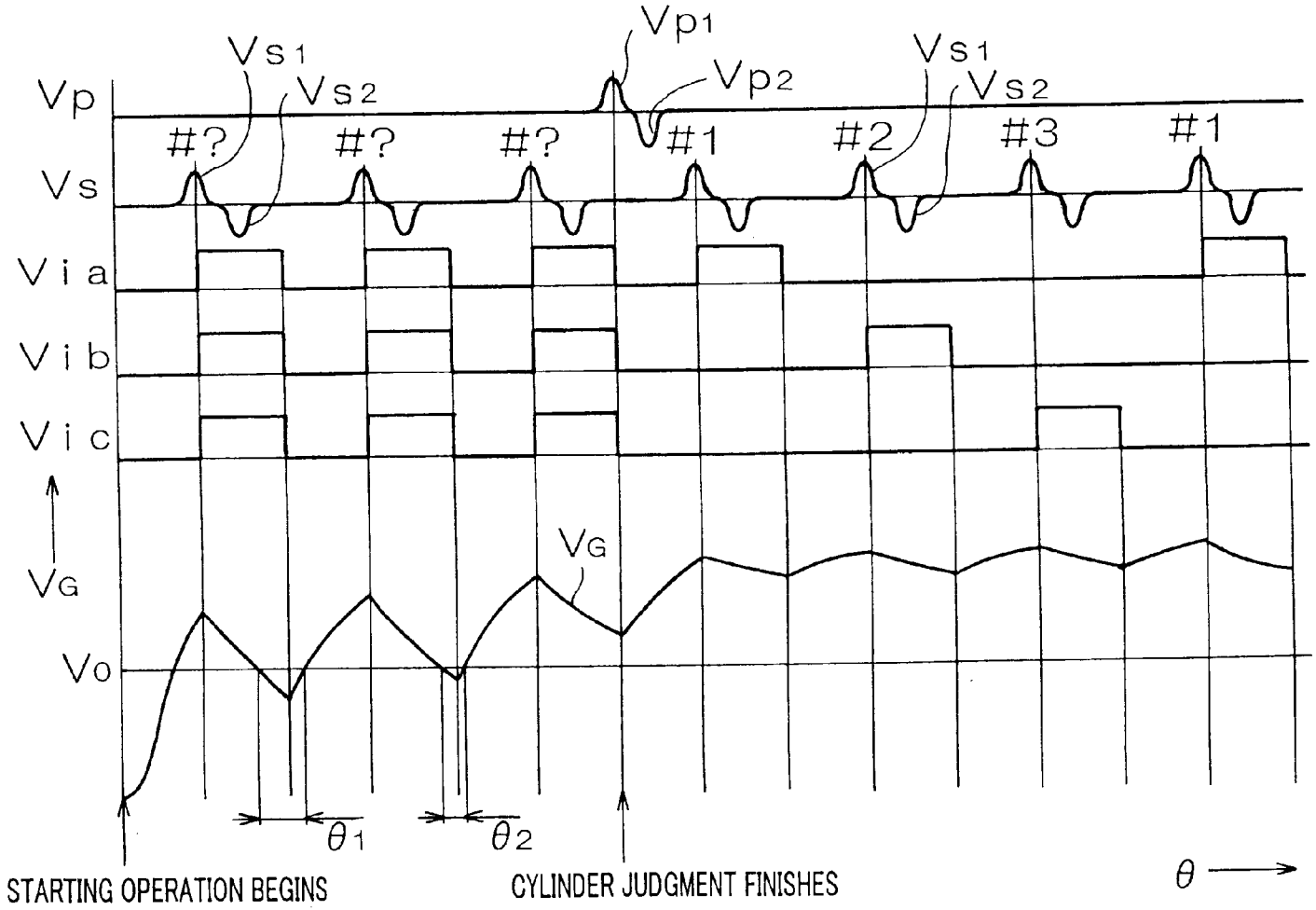
FIG. 3A through 3F illustrate waveforms of voltages at various portions of the prior art fuel injection apparatus together with a rectified output of the generator.

In the prior art batteryless fuel injection apparatus for a multi-cylinder internal combustion engine, as indicated by the code #? in FIG. 3B, in the condition that which cylinder the reference pulse signal Vs1 corresponds to cannot be judged after the starting operation of the engine begins, the injection command signals Via through Vic of the injectors 4*a* through 4*c* for the first through third cylinders are simultaneously generated as shown in FIGS. 3C through 3E so that all the injectors for all the cylinders simultaneously inject the fuel.

In this manner, as all the injectors for all the cylinders simultaneously inject the fuel, the load is concentrated for a short time and therefore the rectified output voltage VG of the generator 10 is lowered much as shown in FIG. 3F so that it is below the minimum operation voltage Vo of the ECU 7 for the distance such as θ1 and θ2 shown in FIG. 3F. The ECU 7 stops its operation while the rectified output voltage of the generator is less than the operation voltage Vo and resumes its operation when the output voltage of the generator is restored to the minimum operation voltage or higher.

As the stop and the resumption of the operation of the ECU 7 are repeated when the engine should start, since the simultaneous injection of the fuel into all the cylinders is repeated, the injection quantity of the fuel gets excessive, which causes the ignition plugs to be excessively wet with the fuel. This sometime disables the engine from starting. Also, as the output voltage of the generator is excessively lowered and is lower than the minimum operation voltage Vo for a longer time, the injection quantity of the fuel gets insufficient for the engine to start.

On the other hand, in order to prevent such problems from arising, the fuel injection apparatus of the invention is provided with start injection command generation means to generate a start injection command signal for each of the injectors or a start injection command signal common to m injectors (m is an integer of more than 1, but less than n) in predetermined provisional order to apply the start injection command signal to the injector drive circuit 7*b* after the starting operation of the engine begins and until the cylinder judgment means can judge the reference pulse signal for each of the cylinders.

In the embodiment of FIG. 2, while it cannot be judged which cylinder the reference pulse signal corresponds to after the starting operation of the engine begins, the start injection command signals Via', Vib' and Vic' for the first through third cylinders are generated, respectively in order of Via', Vib', Vic' and Via' whenever the reference pulse signal Vs1 is generated.

In general, after the starting operation of the engine begins, when the crankshaft rotates for an angle corresponding to at least one ignition cycle, the cylinder can be judged. In the embodiment of FIG. 2, after the starting operation of the engine begins, when the reference pulse signal Vs1 is generated four times and at a position where the cylinder judgment signal Vp1 is generated, the cylinders are judged.

After the cylinders are judged, the injection command signals Via through Vic for the first through third cylinders are generated, respectively when the reference pulse signals for the first through third cylinders are generated, respectively.

In the embodiment of FIG. 2, although only the start injection command signal for one of the cylinders is generated while the judgment of the cylinders cannot be made, the start injection command signals for some cylinders of all the cylinders whenever each of the reference pulse signals is generated. For instance, in case of three cylinders, the start injection command signals such as (Via', Vib'), (Vib', Vic'), (Vic', Via') and so on for the two cylinders may be simultaneously generated whenever each of the reference pulse signal which cannot recognize the corresponding cylinders is generated.

Alternatively, the start injection command signal for one of the cylinders and the start injection command signals for the remaining two cylinders such as Via', (Vib', Vic'), Via', (Vib', Vic') and so on may be alternately generated.

With the start injection command signal for one of the cylinders or the start injection command signals for some of all the cylinders, but not all the cylinders generated in provisional order to apply the start injection command signal to the injector drive circuit, all the injectors 4*a* through 4*c* are never simultaneously the load to the generator. Thus, the output voltage VG of the generator 10 is never below the minimum operation voltage Vo of the ECU 7. Accordingly, the ECU is prevented from being unstably operated due to the lowered output of the generator and from stopping the operation. Furthermore, there occurs no trouble such as the engine fails to start due to the insufficient operation of the ECU on the power voltage variation and the engine is hard to start because the ignition plugs are wet with the excessive fuel.

With the fuel injection made in provisional order immediately after the starting operation of the engine begins as aforementioned, when the fuel is injected at the normal injection start position on the normal injection command signal generated by the steady-state injection command generation means after the cylinder can be judged, the excess or the deficiency of the actual fuel injection quantity relative to the required injection quantity in the specific cylinder possibly causes the ignition plugs to be too wet with the fuel so that the engine fails to start or the fuel to be insufficient for the engine to start.

To avoid the problems, in the embodiment of the invention, the ECU accomplishes start injection time storage means to store as a start injection time an accumulative value of injection time for which the fuel is injected by the injector for each of the cylinders in accordance with the start injection command signal and injection quantity correction means to judge the excess or the deficiency of the quantity of the fuel already injected by the injector for each of the cylinders relative to the required quantity of fuel injection of each of the cylinders from the start injection time stored in the start injection time storage means when the injection command signal for each of the cylinders is switched from the start injection command signal to the normal injection command signal generated by the steady-state injection command generation means and correct the signal width of the injection command signal generated by the steady-state injection command generation means so as to reduce the excess or the deficiency of the fuel quantity in such a manner as the signal width of the normal injection command signal generated by the steady-state injection command generation means is narrowed or the first normal injection command signal stops from being generated in case that the quantity of the fuel already injected at each of the cylinders is more than the required injection quantity before the judgment of the cylinder finishes and the signal width of the normal injection command signal generated by the steady-state injection command generation means is widened in case that the quantity of the fuel already injected to each of the cylinders is less than the required injection quantity.

In the embodiment of FIG. 2, although the provisional start fuel injections for the second and third cylinders of the engine are made once, respectively until the cylinder can be judged, since the start fuel injection for the first cylinder is made twice, the first normal injection command signal Via shown in a reference a in FIG. 2C is adapted to stop being generated so that the fuel injection quantity of the first cylinder gets never excessive. Otherwise, the signal width of the first normal injection command signal may be narrowed instead of stopping its generation.

In the aforementioned embodiment, the excess or deficiency of the injected fuel is estimated from the start injection time, it may be estimated from the number of times of the start fuel injection made for each of the cylinders while the cylinders cannot be judged. In this case, there may be provided start injection frequency storage means to store the number of times of the fuel injection made by the injector for each of the cylinders in accordance with the start injection command signal and the excess or the deficiency of the fuel already injected from the injector can be judged from the number of times of the fuel injections for each of the cylinders stored in the start injection frequency storage means.

With the injection quantity correction means provided as aforementioned, the excess or the deficiency of the fuel injection quantity in the specific cylinder can be prevented when the engine should start and therefore the startability of the engine can be improved.

According to the invention, since the start injection command signal for each of the cylinders or the start injection command signals common to some of the cylinders are generated in provisional order after the starting operation of the engine begins and until the cylinder judgment means can judge the cylinders to apply the start injection signal or signals to the injector drive circuit, all the injectors can be never the load to the generator in the state where the generator cannot generate the sufficient output. Thus, the ECU is prevented from being unstably operated due to the lowered output of the generator and from stopping the operation. Furthermore, there occurs no trouble such as the engine fails to start due to the insufficient operation of the ECU on the power voltage variation and the engine is hard to start because the ignition plugs are wet with the excessive fuel.

Although some preferred embodiments of the invention have been described and illustrated with reference to the accompanying drawings, it will be understood by those skilled in the art that they are by way of examples, and that various changes and modifications may be made without departing from the spirit and scope of the invention, which is defined only to the appended claims.

What is claimed is:

1. A batteryless fuel injection apparatus for a multi-cylinder internal combustion engine having n (n is an integer of 2 or more) cylinders comprising n injectors provided for said cylinders of said multi-cylinder internal combustion engine and having a valve to be opened when a drive current of valve opening level or higher is applied to said injectors to inject a fuel, a generator driven by said internal combustion engine, an electric power circuit to generate a predetermined DC voltage using said generator as an electric power supply, a signal generation device to generate pulse signals including a reference pulse signal for each of said cylinders at a reference rotational angle position set relative to each of said cylinders, cylinder judgment means to judge which cylinder each reference pulse signal generated by said signal generation device corresponds to, injection quantity arithmetical operation means to arithmetically operate an injection quantity of the fuel from said injector for each of said cylinders while a rotation information obtained from the pulse signal generated by said signal generation device and control conditions obtained from various sensors are used, steady-state injection command generation means to generate an injection command signal for each of said cylinders having a signal width necessary for injecting the fuel from said injector for each of the cylinders in the injection quantity arithmetically operated by said injection quantity arithmetical operation means at the injection start position for each of said cylinders determined relative to the generation position of said reference pulse signal for each of said cylinders judged by said cylinder judgment means and an injector drive circuit to supply a drive current to said injector for each of said cylinders using the output voltage of said electric power circuit as an electric power voltage while said injection command signal for each of the cylinders is generating, said batteryless fuel injection apparatus further comprising start injection command generation means to generate a start injection command signal for each of said injectors or a start injection command signal common to m injectors (m being an integer of more than 1, but less than n) in predetermined provisional order to apply said start injection command signal to said injector drive circuit.

2. A batteryless fuel injection apparatus for a multi-cylinder internal combustion engine as set forth in claim 1, and wherein said start injection command generation means is so constructed as to generate said start injection command signal whenever said signal generation device generates said reference pulse signal for each of said cylinders.

3. A batteryless fuel injection apparatus for a multi-cylinder internal combustion engine as set forth in claim 1 or 2, and further comprising start injection time storage means to store as a start injection time an accumulative value of injection time for which the fuel is injected by said injector for each of said cylinders in accordance with said start injection command signal and injection quantity correction means to judge an excess or a deficiency of the quantity of said fuel already injected by said injector for each of said cylinders relative to a required fuel injection quantity of each of said cylinders from said start injection time stored in said start injection time storage means when the injection command signal for each of said cylinders is switched from said start injection command signal to the normal injection command signal generated by said steady-state injection command generation means and control the normal injection command signal generated by said steady-state injection command generation means so as to reduce the excess or the deficiency of the fuel quantity.

4. A batteryless fuel injection apparatus for a multi-cylinder internal combustion engine as set forth in claim 1 or 2, and further comprising start injection time storage means to store as a start injection time an accumulative value of injection time for which the fuel is injected by said injector for each of said cylinders in accordance with said start injection command signal and injection quantity correction means to judge an excess or a deficiency of the quantity of the fuel already injected by said injector for each of said cylinders relative to a required fuel injection quantity of each of said cylinders from the start injection time stored in said start injection time storage means when the injection command signal for each of said cylinders is switched from the start injection command signal to the normal injection command signal generated by said steady-state injection command generation means and correct the fuel injection quantity from said injector for each of said cylinders so as to reduce said excess or said deficiency of the fuel quantity in such a manner as a signal width of the normal injection command signal generated by said steady-state injection command generation means is narrowed or the normal injection command signal to be first generated stops from being generated in case that the quantity of the fuel already injected by said injector for each of said cylinders is more than said required injection quantity and a signal width of the normal injection command signal generated by said steady-state injection command generation means is widened in case that the quantity of the fuel already injected by said cylinder is less than said required injection quantity.

5. A batteryless fuel injection apparatus for a multi-cylinder internal combustion engine as set forth in claim 1 or 2, and further comprising start injection frequency storage means to store the number of times of the fuel injection made by said injector for each of said cylinders in accordance with the start injection command signal and injection quantity correction means to judge an excess or a deficiency of the quantity of the fuel already injected by said injector for each of said cylinders relative to a required fuel injection quantity of each of said cylinders from the number of times of the fuel injection stored in said start injection frequency storage means when the injection command signal for each of said cylinders is switched from the start injection command signal to the normal injection command signal generated by said steady-state injection command generation means and control the normal injection command signal generated by said steady-state injection command generation means so as to reduce the excess or the deficiency of the fuel quantity.

6. A batteryless fuel injection apparatus for a multi-cylinder internal combustion engine as set forth in claim 1 or 2, and further comprising start injection frequency storage means to store the number of times of the fuel injection made by said injector for each of said cylinders in accordance with the start injection command signal and injection quantity correction means to judge an excess or a deficiency of the quantity of the fuel already injected by said injector for each of said cylinders relative to a required fuel injection quantity of each of said cylinders from the number of times of the fuel injection stored in said start injection number storage means when the injection command signal for each of said cylinders is switched from the start injection command signal to the normal injection command signal generated by said steady-state injection command generation means and correct the fuel injection quantity from said injector for each of said cylinders so as to reduce said excess or said deficiency of the fuel quantity in such a manner as a signal width of the normal injection command signal generated by said steady-state injection command generation means is narrowed or the normal injection command signal to be first generated stops from being generated in case that the quantity of the fuel already injected at each of said cylinders is more than said required injection quantity and a signal width of the normal injection command signal generated by said steady-state injection command generation means is widened in case that the quantity of the fuel already injected at each of said cylinders is less than said required injection quantity.

7. A batteryless fuel injection apparatus for a multi-cylinder internal combustion engine as set forth in either of claims 1 through 6 and wherein said generator has a load of said fuel pump to supply said fuel to said injectors.

* * * * *